United States Patent [19]

Kawai et al.

[11] Patent Number: 4,671,930

[45] Date of Patent: Jun. 9, 1987

[54] HIGH HARDNESS AND HIGH TOUGHNESS NITRIDING POWDER METALLURGICAL HIGH-SPEED STEEL

[75] Inventors: Nobuyasu Kawai, Kobe; Minoru Hirano, Nishinomiya; Hajime Esaka, Akashi; Hirofumi Fujimoto, Ono, all of Japan

[73] Assignee: Kabushiki Kaisha Kobe Seiko Sho, Kobe, Japan

[21] Appl. No.: 746,120

[22] Filed: Jun. 18, 1985

[30] Foreign Application Priority Data

Jun. 20, 1984 [JP] Japan ..... 59-128287

[51] Int. Cl.[4] ..... C22C 38/22

[52] U.S. Cl. ..... 420/107; 420/110; 420/111

[58] Field of Search ..... 75/126 C, 126 J, 126 E, 75/126 H, 126 A, 251, 246; 148/318, 16.6; 420/105, 107, 110, 111, 114

[56] References Cited

U.S. PATENT DOCUMENTS 4,121,930 10/1978 Yukawa et al. ..... 75/126 E
4,140,527 2/1979 Kawai et al. ..... 75/126 J
4,469,514 9/1984 Holtz, Jr. ..... 75/126 E

FOREIGN PATENT DOCUMENTS 0647349 2/1979 U.S.S.R. ..... 75/126 J

*Primary Examiner*—L. Dewayne Rutledge
*Assistant Examiner*—Deborah Yee
*Attorney, Agent, or Firm*—Oblon, Fisher, Spivak, McClelland & Maier

[57] ABSTRACT

A high-speed steel obtained by powder metallurgy processing wherein a chemical composition includes, by weight %, C: a quantity (%) which satisfies with the following formula $$Ceq + 0.15 = C + \frac{12}{14} N = Ceq + 0.35$$

where

Ceq=0.19+0.017 (W+2Mo)+0.22 V

N, W, Mo and V are respectively the content (%) in steel

| | |
|---|---|
| Cr: 3-5% | V: 6.0-8.5% |
| Mo: 4-7.5% | Co: 5-15% |
| W: 5-7% | N: 0.2-1.7% |

and the remainder is Fe, and (W+2Mo) is 15-20% is disclosed.

4 Claims, 9 Drawing Figures

HIGH HARDNESS AND HIGH TOUGHNESS NITRIDING POWDER METALLURGICAL HIGH-SPEED STEEL

FIELD OF THE INVENTION

The present invention relates to high-speed steel (hereinafter referred to as "powder metallurgical high-speed steel") obtained by powder metallurgy processing, and more particularly, to powder metallurgical high-speed steel having high hardness and high wear resistance excellent in adhesion wear resistance.

DESCRIPTION OF THE PRIOR ART

Recently, higher precision and lower cost are becoming increasingly required metallic blank working, and working conditions such as higher workpiece hardness or higher working speed are becoming also increasingly severe. Therefore, there has been a tendency of switching from using high-speed steel to using sintered hard alloys in the production of cutting tools. It is however considered that for precision tools requiring easiness of machining and toughness, high hardness and high toughness high-speed steel tools and coating high-speed steel tools will be used also in future.

At present, the AISI-M40 steel series has been developed for high hardness ($H_RC65$–70) high-speed steel. In steel of this kind, 5 weight % (hereinafter referred merely to %) or more of Co is added to increase hardness to increase C%, and V% is lowered to prevent toughness from lowering. On the other hand, an attempt has been made in Japanse Patent Laid-Open Nos. 11810/79 to 11813/79 to add N as a chemical composition of high-speed steel thereby further enhancing various performances of high-speed steel, which attempt has been given attention to provide nitriding powder metallurgical high-speed steel.

However, the aforesaid high hardness high-speed steel is produced by a solving process, and therefore, a segregation of carbide tends to occur. Moreover, the heat treating condition is severe and hot workability is poor and because the content of V is low, adhesion wear resistance is also poor. On the other hand, in the aforesaid nitriding powder metallurgical high-speed steel, an improvement in cutting performance is achieved without involving any problem of heat treatment or without adversely affecting mechanical properties such as toughness, but this steel suffers in terms of adhesion wear resistance. Furthermore, powder metallurgical high-speed steel having high hardness and high deflective strength is greatly desired to withstand severe cutting conditions.

SUMMARY OF THE INVENTION

The present invention has been achieved in view of the problems noted above and has as its object to provide high hardness and high toughness powder metallurgical high-speed steel which is excellent in coagulant and abrasion resistance as well as hot workability.

To achieve the aforementioned object, the present invention has taken the following means. That is, a chemical composition of powder metallurgical high-speed steel includes, by weight %, C: a quantity (%) which satisfies with the following formula $$Ceq + 0.15 \leqq C + \frac{12}{14} N \leqq Ceq + 0.35$$

where $Ceq = 0.19 + 0.017(W + 2Mo) + 0.22V$

N, W, Mo and V are respectively the content (%) in steel

| | |
|---|---|
| Cr: 3–5% | V: 6.0–8.5% |
| Mo: 4–7.5% | Co: 5–15% |
| W: 5–7% | N: 0.2–1.7% |

and the remainder is Fe, and (W+2Mo) is 15–20%.

DETAILED DESCRIPTION OF THE INVENTION AND PREFERRED EMBODIMENTS

Figure 1:
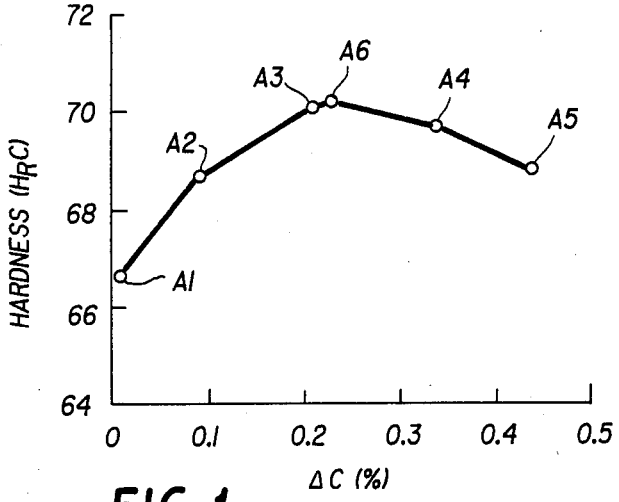
FIG. 1 is a view showing the relation between ΔC and hardness.

The nitriding powder metallurgical high-speed steel according to the present invention is composed of the aforementioned component elements. With respect to the composition range of these component elements limited reasons will be described hereinafter referring to specific embodiments.

C has a close relation with the carbide forming elements such as Cr, Mo, W, V, etc. and thus greatly affects hardness, bending strength and like properties high-speed steel. Therefore, the C content should be determined in consideration of relation with the compounding quantity of the carbide forming elements, particularly, Mo, W and V. For example, "IRON AND STEEL" (Vol. 45, No. 5, pp. 511–516) discloses the following formula:

$$Ceq = 0.19 + 0.017(W + 2Mo) + 0.22V$$

In this technical field, it is not substantially possible to employ that the C content be determined without consideration of relation with W, Mo and V (the above-described formula is a calculation formula with Cr held constant at about 4%). It is to be noted that the N content is also considered for such determination, which will be described hereinafter.

N has properties similar to those of C as an alloying element In particular, both N and C have the small atomic weight of 12 and 14, respectively and are both penetrating types of atoms with respect to steel and therefore tend to form stabilized alloy compounds. Therefore, under the intention of the present invention requiring to contain much N, a conclusion was reached to the effect that the quantity of C and that of N should be related to each other to establish the contents of both elements rather than to independently adjust the N content.

The following experiments were conducted for the purpose of obtaining a given object along the line as described above.

Powder steel composed of an alloy composition as shown in Table 1 was produced by gas atomizing process and subjected to nitriding, after which a fine billet was obtained by so-called HIP. This billet was used as a specimen to obtain the highest heat treating hardness and deflective stength thereof. The results are given in FIGS. 1 and 2.

It is to be noted that in Table 1 there is an equation:

$$\Delta C = \left(C + \frac{12}{14} N\right) - Ceq$$

because it is considered that C and N are elements having substantially the same effect in this technical field as previously mentioned and they can be regarded equal to each other if a difference in atomic weight is converted.

TABLE 1

| Specimen | Chemical Components (Weight %) | | | | | | | | |
|---|---|---|---|---|---|---|---|---|---|
| | C | N | Cr | W | Mo | V | Co | Ceq | ΔC |
| A1 | 2.01 | 0.22 | 3.96 | 5.83 | 6.01 | 7.70 | 7.91 | 2.19 | 0.01 |
| A2 | 2.00 | 0.32 | 3.96 | 5.83 | 6.01 | 7.70 | 7.91 | 2.19 | 0.09 |
| oA3 | 2.09 | 0.26 | 4.10 | 5.91 | 5.87 | 7.30 | 8.10 | 2.10 | 0.21 |
| oA4 | 1.84 | 0.65 | 4.25 | 6.14 | 5.67 | 7.20 | 7.86 | 2.07 | 0.34 |
| A5 | 2.01 | 0.72 | 3.96 | 5.83 | 6.01 | 7.70 | 7.91 | 2.19 | 0.44 |
| A6 | 2.31 | 0.07 | 4.15 | 6.05 | 6.02 | 7.45 | 7.72 | 2.14 | 0.23 |

Note:
1. The remainder is substantially Fe.
2. Specimen marked by the symbol "circle" corresponds to the powder metallurgical high-speed steel according to the present invention.

Figure 2:
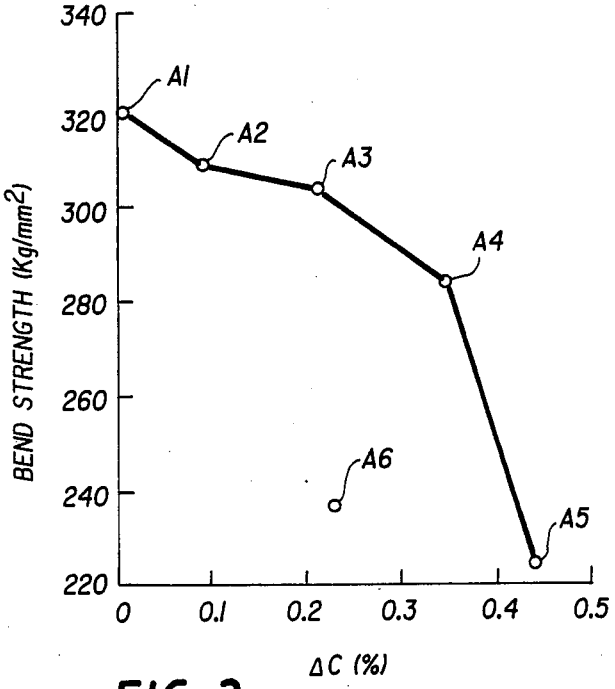
FIG. 2 is view showing the relation between ΔC and bending strength.

It has been found from FIGS. 1 and 2 that if ΔC is 0.15% to 0.35%, high hardness ($H_RC69$ or more) and high toughness (bending strength, 270 kg/mm$^2$ or more) are obtained.

Figure 3:
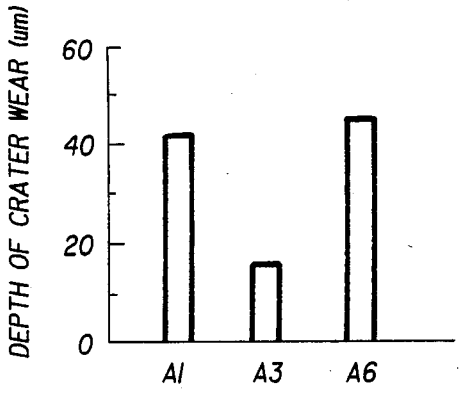
FIG. 3 is a view showing the depth of crater wear in a cutting test.

Further, cutting tools are trially produced from blanks, A1, A3 and A6 shown in Table 1. Cutting tests were carried out with SNCM 439 used as a workpiece, and the crater abrasive depth of the cutting tool as shown in FIG. 3 resulted. The cutting conditions were as shown below.

| | | | |
|---|---|---|---|
| Cutting speed: | 20 m/min. | Cutting length: | 200 m |
| Depth of cut: | 1.5 mm | Feed: | 0.2 mm/rev. |
| Lubricant: | None | | |

As can be seen from FIG. 3, samples having small in depth of crater wear were limited to those samples in which the N content is more than 0.2%; and A6 in which the N content is 0.07% has the crater abrasion about twice of A3 which is substantially equal in hardness.

Since N is coupled to V to form a vanadium nitride (VN), it need be contained in balance with the V content. The proportion of weight of N in the VN is 0.2, and in case the present invention, the maximum content of V is 8.5% as described later, and therefore, the upper limit of the N content is $8.5 \times 0.2 = 1.7\%$. Even if N in excess of 1.7% is contained, there brings forth no effect, and conversely, deterioration in fatigue undesirably results.

Cr is effective to prevent softening and oxidation at high temperatures. Cr quantities of less than 3% bring forth less effect previously described whereas if quantities exceeding 5% are used, said effect results but deterioration in toughness undesirably results.

The W equivalent (W+2Mo) is controlled to a predetermined value to secure hardness. If the W equivalent is less than 15%, it becomes difficult to secure hardness above $H_RC69$, whereas if it exceeds 20%, reduction of area lowers to materially worsen the hot workability. If W is less than 5%, the heat resistance lowers whereas if it exceeds 7%, toughness undesirably lowers.

Mo is contained in balance with W but in case of the present invention, if Mo is less than 4%, heat resistance lowers whereas if it exceeds 7.5%, the toughness undesirably lowers.

V is contained to provide an abrasion resistance, and if V is less than 6%, the abrasion resistance lowers whereas if it exceeds 8.5%, carbon nitride becomes coarse and the value of reduction of area abruptly lowers.

Co is contained to enhance hardness. If Co quantities of less than 5% are used, the aforesaid effect is small, whereas if it exceeds 15%, the toughness materially lowers, which is not favorable.

In order to examine mechanical properties in terms of W equivalent, and contents of V and Co, powder steel composed of the alloy compositions shown in Table 2 and powder steel in the previously mentioned Table 1 A3 were produced by the gas atomizing process, and they were subjected to nitriding, after which a fine billet was prepared by HIP to examine hardness, bend strength, reduction of area (according to a (1050° C.) high temperature and high speed tensile test), and the like. The results are given in FIGS. 4 to 9.

TABLE 2

| Specimen | Chemical Components (Weight %) | | | | | | | | |
|---|---|---|---|---|---|---|---|---|---|
| | C | N | Cr | W | Mo | V | Co | Ceq | ΔC |
| A7 | 1.84 | 0.45 | 3.85 | 6.01 | 3.41 | 7.31 | 7.51 | 2.02 | 0.21 |
| oA8 | 1.81 | 0.65 | 3.87 | 6.11 | 4.97 | 7.67 | 8.41 | 2.15 | 0.22 |
| A9 | 1.96 | 0.47 | 4.03 | 6.54 | 7.48 | 7.11 | 7.68 | 2.12 | 0.24 |
| A10 | 1.52 | 0.32 | 4.01 | 6.10 | 6.02 | 4.96 | 8.01 | 1.59 | 0.21 |
| oA11 | 1.77 | 0.43 | 4.10 | 5.26 | 6.35 | 6.33 | 8.45 | 1.89 | 0.25 |
| A12 | 2.41 | 0.45 | 3.98 | 6.51 | 5.81 | 9.51 | 8.14 | 2.59 | 0.21 |
| A13 | 1.98 | 0.41 | 3.95 | 6.05 | 6.08 | 7.37 | 2.96 | 2.12 | 0.21 |
| oA14 | 1.83 | 0.70 | 4.00 | 6.78 | 5.24 | 7.95 | 13.01 | 2.23 | 0.20 |
| A14 | 1.91 | 0.55 | 4.03 | 5.97 | 6.11 | 7.55 | 20.12 | 2.16 | 0.22 |

Note:
1. The remainder is substantially Fe.
2. Specimen marked by the symbol "circle" corresponds to the powder metallurgical high-speed steel according to the present invention.

Figure 4:
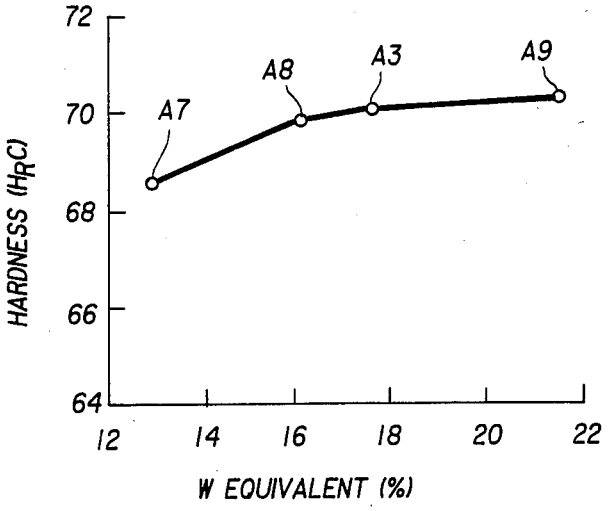
FIG. 4 is a view showing the relation between W equivalent and hardness.
Figure 5:
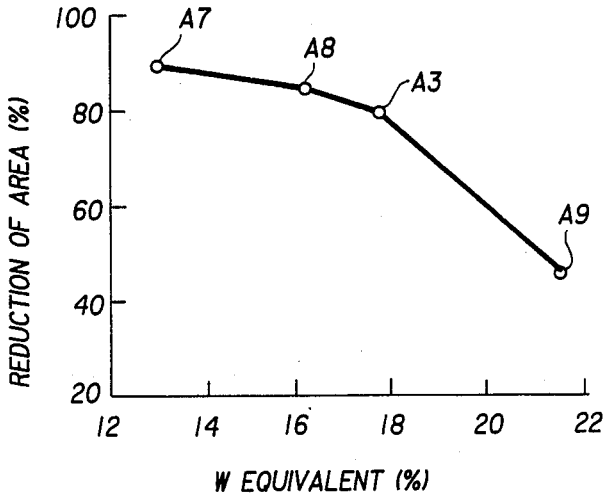
FIG. 5 is a view showing the relation between W equivalent and reduction of area.

FIGS. 4 and 5 are respectively views showing the relation between W equivalent (W+2Mo), hardness and reduction of area. A3 (W equivalent: 17.65%) and A8 (W equivalent: 16.05%) show good values, i.e., hardness $H_RC$—above 69 and reduction of area—above 80%. However, A7 whose W equivalent is 12.83% which is below a stipulated value and hardness is low, which is below $H_RC69$. On the other hand, A9 whose W equivalent is 21.05% which is above a stipulated value is excellent in hardness but reduction of area thereof abruptly lowers.

Figure 6:
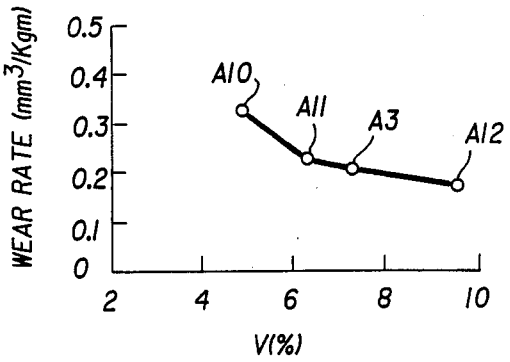
FIG. 6 is a view showing the relation between V content and wear rate.
Figure 7:
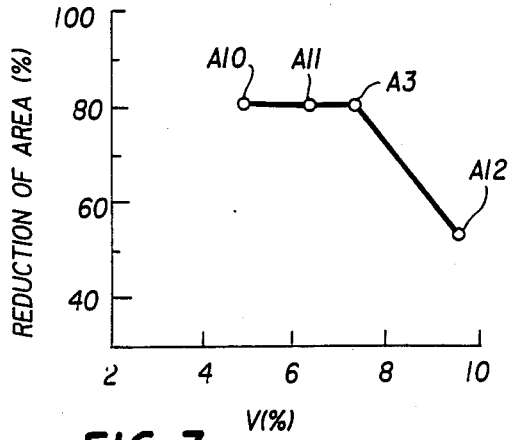
FIG. 7 is a view showing the relation between V content and reduction of area.

FIGS. 6 and 7 are respectively views showing the relation between V content, wear rate and reduction of area. A3 (V: 7.3%) and All (V: 6.33%) have a wear rate—below $0.3\times10^{-4}$ $mm^2/kg.m$ and reduction of area—above 80%, which are favorable values whereas A10 whose V is 4.96% which is below a stipulated value is excellent in specific abrasive amount but reduction of area thereof abruptly lowers. Here, the wear rate was measured by an OHGOSHI type wear test under the conditions of a mating material SNCM 439, final load—6.3 kg, friction distance—400 m, no-lubricant, and friction speed—0.3 m/sec.

Figure 8:
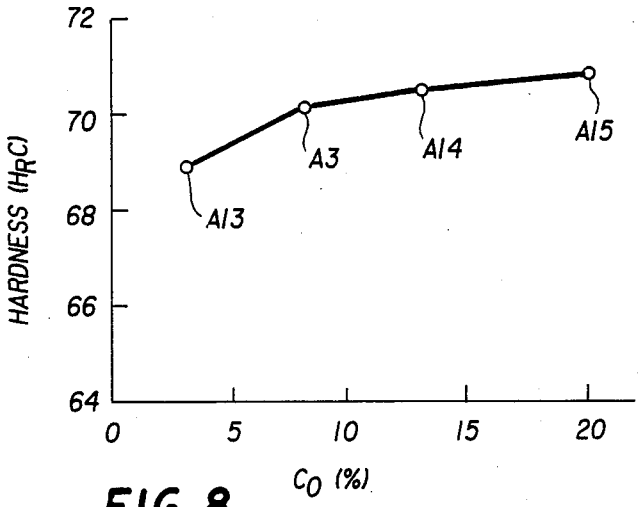
FIG. 8 is a view showing the relation between Co content and hardness.
Figure 9:
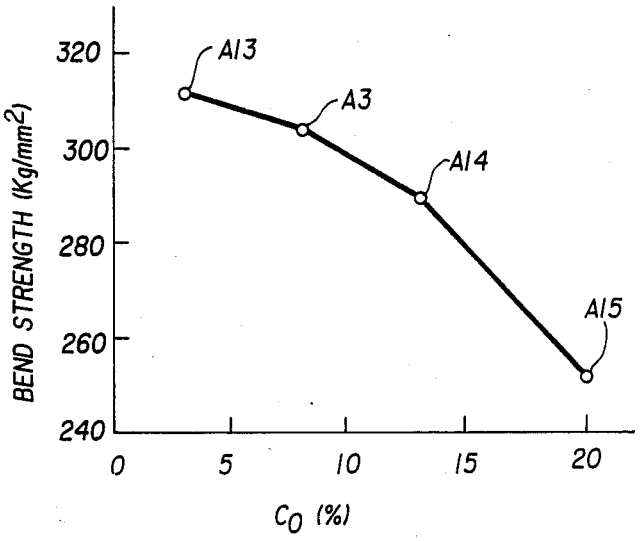
FIG. 9 is a view showing the relation between Co content and bending strength.

FIGS. 8 and 9 are respectively views showing the relation between Co content, hardness and deflective strength. A3 (Co: 8.10%) and A14 (Co: 13.01%) according to the present invention have a hardness—above $H_RC70$ and bending strength—above 280 $kg/mm^2$ which are favorable values. Whereas A13 whose Co is 2.96% which is below a stipulated value has a good bending strength but a hardness thereof is somewhat short. A15 whose Co is 20.12% which is above a stipulated value is excellent in hardness but is extremely low in deflective strength.

As described above, in the nitriding powder metallurgical high-speed steel according to the present invention, C% is determined in connection with N% and Ceq. Therefore, the high-speed steel of the invention is excellent in adhesion wear resistance as well as hot workability and has a hardness above $H_RC69$ which is close to that of sintered hard alloy and high toughness of bending strength above 270 $kg/mm^2$ and high toughness.

What is claimed is:

1. A high hardness and high toughness nitriding powder metallurgical high-speed steel, consisting essentially of (i) C in a weight % quantity which satisfies the following formula $$Ceq + 0.15 \leqq C + \frac{12}{14} N \leqq Ceq + 0.35$$

where $Ceq=0.19+0.017(W+2Mo)+0.22V$;

(ii) Cr, N, W, Mo, Co and V in the following respective weight %,

| | |
|---|---|
| Cr: 3–5% | V: 6.0–8.5% |
| Mo: 4–7.5% | Co: 5–15% |
| W: 5–7% | N: 0.2–1.7%; |
| | W + 2Mo: 15–20% and |

(iii) the balance being iron and inevitable impurities.

2. The high speed steel of claim 1, wherein W+2Mo is 16 weight % to 19 weight %.

3. The high-speed steel of claim 1 wherein V is 7 weight % to 8 weight %.

4. The high-speed steel of claim 1, wherein Co is 7 weight % to 10 weight %.

* * * * *